US005123606A

United States Patent [19]

Braun et al.

[11] Patent Number: 5,123,606

[45] Date of Patent: Jun. 23, 1992

[54] REEL MANDREL WITH AUXILIARY SPREADING FOR A STRIP REEL

[75] Inventors: Martin Braun, Kreuztal; Joachim Pfeiffer; Helga Treutmann, both of Hilchenbach, all of Fed. Rep. of Germany

[73] Assignee: SMS Schloemann-Siemag Aktiengesellschaft, Duesseldorf, Fed. Rep. of Germany

[21] Appl. No.: 571,768

[22] Filed: Aug. 22, 1990

[30] Foreign Application Priority Data

Aug. 24, 1989 [DE] Fed. Rep. of Germany ..... 3927915

[51] Int. Cl.[5] ..... B65H 75/24

[52] U.S. Cl. ..... 242/72.1

[58] Field of Search ..... 242/72.1, 78.1, 78.6; 279/2 R, 2 A

[56] References Cited

U.S. PATENT DOCUMENTS 1,668,990 5/1928 Tromblay ..... 242/72.1
2,578,953 12/1951 Tyrrell ..... 242/72.1 X
3,116,891 1/1964 Anderson et al. ..... 242/72.1
4,285,528 8/1981 Neamtu ..... 242/72.1 X
4,492,346 1/1985 Young ..... 242/72.1
4,953,806 9/1990 Rothenpieler ..... 242/72.1

FOREIGN PATENT DOCUMENTS 269904 5/1970 U.S.S.R. .

*Primary Examiner*—John M. Jillions
*Attorney, Agent, or Firm*—Akoo-Toren

[57] ABSTRACT

In a strip reel for winding up metal strips to form a coil and winding off metal strips from a coil, respectively, in such a way that the edges are aligned, particularly for winding a rolled hot strip, a driven reel mandrel which is supported so as to be rotatable, substantially comprising a mandrel body, segments and spreading bar, wherein the reel mandrel can be spread in the radial direction by the spreading bar, which is movable axially in the mandrel body, with the intermediary of a coupling of a rotating drive, it is suggested that the reel mandrel be equipped with a device for auxiliary spreading, which device acts mechanically on the axial movability of the spreading bar in the event that the coil cannot be easily removed from the winding mandrel because of disturbances.

9 Claims, 3 Drawing Sheets

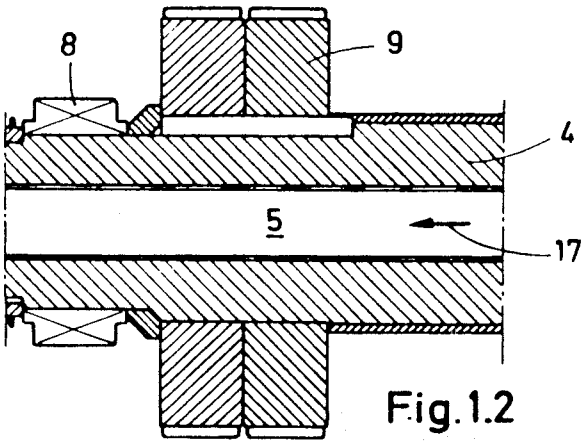
Fig.1.2
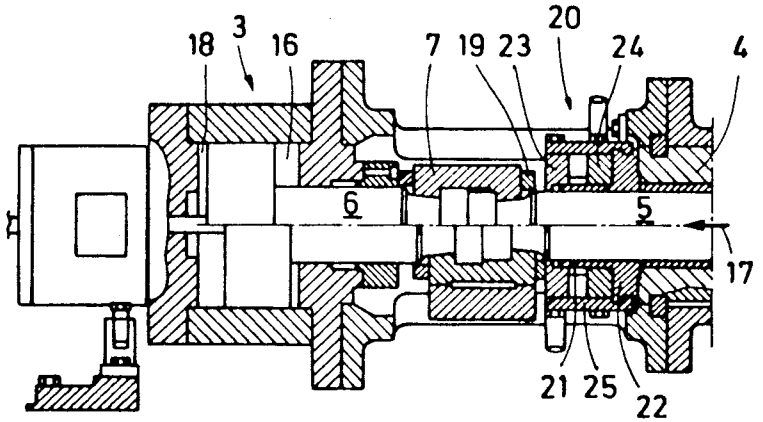
Fig.1.1
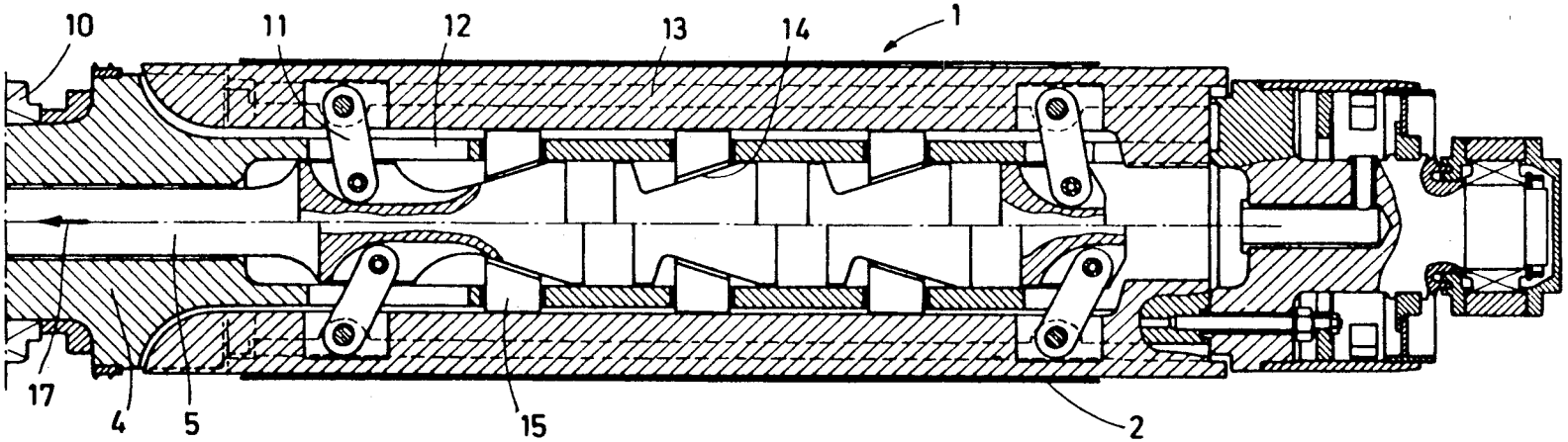
Fig.1.3

REEL MANDREL WITH AUXILIARY SPREADING FOR A STRIP REEL

BACKGROUND OF THE INVENTION

1. Field of the Invention

The invention is directed to a strip reel for winding up metal strips to form a coil and winding off metal strips from a coil, respectively, in such a way that the edges are aligned, particularly for winding a rolled hot strip, comprising a driven reel mandrel which is supported so as to be rotatable, substantially comprising a mandrel body, segments and spreading bar, wherein the reel mandrel can be spread in the radial direction by the spreading bar, which is movable axially in the mandrel body, with the intermediary of a coupling and a rotating drive.

2. Description of the Related Art:

In order to wind up or unwind strip-shaped material, e.g. a hot-rolled or cold-rolled steel strip, a strip reel with spreadable reel mandrel is conventionally provided. However, such strip reels are exposed to every kind of unfavorable operating condition, e.g. high speeds, cantilever beam loads, heat, water and centrifugal force, all of which greatly impede the performance or the operating behavior of the reel and cause high maintenance costs. A typical reel for winding up a hot strip in hot strip rolling mills is consequently dynamically and thermally loaded to an extremely high degree, since hot strips with a strip thickness of e.g. 25 mm or a strip width of e.g. 2100 mm must be wound to form a coil weighing up to 45 t at 200,000 strip entries per year. The strength of the different construction elements of the reel and its maintenance capacity must therefore be carefully taken into account.

A strip reel having the basic design principle according to the construction type described in the beginning is known from DE-PS 32 41 870. For the purpose of winding up metal strips to form a coil and winding off metal strips from a coil, respectively, in such a way that the edges are aligned, this strip reel, which is already known, comprises devices for displacing the coil transversely relative to the strip running direction during the winding and unwinding, which devices are constructed in such a way that a readjustment of the coil is effected relative to the running strip edge in that the winding shaft is supported in a machine column so as to be axially displaceable and is guided out of the machine column on the side opposite the winding mandrel and placed on a mounting gear unit which is connected with the drive motor via a universal-joint shaft which compensates for movement. The particular problems to be taken into account when winding hot strips are not addressed in the strip reel known from DE-PS 32 41 870.

Reel mandrels for hot strip reels are generally moved, according to the present state of the art, with after-spreading. After-spreading means that the reel mandrel is closed during the strip entry and is spread subsequently to approximately 90% of the spreading amount only after one to three windings. A reliable grasping of the first windings and a faster build-up of strip tension is achieved by means of this manner of movement. The actuation of the spreading movement is effected by means of a rotating hydraulic cylinder, wherein the command for actuating the hydraulic cylinder is effected automatically by means of determining the distance of the strip tip. Although the reliability of the control devices has constantly been improved over the course of time, it cannot be avoided absolutely that the after-spreading movement of the reel mandrel is not effected and the coil is wound on a closed mandrel. Since the reel mandrel can usually not be closed further in this situation, there have been substantial problems in removing the wound coil, which weighs several tons, from the reel mandrel, since the coil sits too tightly on the reel mandrel. Therefore, it has been suggested in a reel arrangement to loosen the coil from the reel mandrel by switching the rotating direction of the reel mandrel. The tightly wound coil should accordingly open in a helical manner in order to release the winding mandrel. The mandrel can subsequently spread, the coil can be tightened and removed after the spreading of the mandrel. This procedure can result in damage to the strip so that the coil must be scrapped.

SUMMARY OF THE INVENTION

It is the object of the present invention to enable the removal of the hot strip, which is to be wound on the reel mandrel to form a coil, as a finished coil in a reliable manner and without damaging the reel mandrel also when the after-spreading movement of the reel mandrel cannot be carried out, with the previously described disadvantageous results, for electrical, mechanical or other reasons.

According to the present invention, the reel mandrel in a strip reel of the generic type named in the beginning is equipped, with a device which acts mechanically on the axial movability of the spreading bar for the purpose of auxiliary spreading with the advantage that the axial length of the spreading bar is released by means of an unlocking of the mechanical auxiliary spreading in the event that the after-spreading is not possible and the coil is securely connected with the reel mandrel, so that the spreading bar can be moved in a direction in which the diameter of the reel mandrel is reduced subsequently by a determined amount. When the diameter of the reel mandrel is reduced, the coil can be stripped off according to the conventional method and with the conventional devices even though the after-spreading does not function.

A development of the invention provides that the device for auxiliary spreading is arranged between the mandrel body and the coupling of the rotating drive, which is provided with a liftlimiting device, and encloses the spreading bar in an annular manner. In this way, the auxiliary spreading device is arranged in an easily accessible area of the reel installation and can therefore be easily and quickly actuated in case of disturbance. The auxiliary spreading device advisably comprises an annular centering sleeve which is slid onto the spreading bar and comprises a formed on flange, which is connectable with the mandrel body, and at least two cam disks which are at a distance from one another, held on the centering sleeve so as to be rotatable and change with respect to their distance from one another, as well as at least one holding piece which is detachably connected with the cam disks for the purpose of unlocking. These machine elements of the invention enable a compact construction with correspondingly good installation possibilities, so that the mandrel body is not appreciably lengthened and the diameter of the mandrel body is not increased beyond the necessary diametrical proportions.

Another construction of the invention provides that the holding piece is fixed with respect to rotation, as well as so as to be free of play in the axial direction, by means of support elements acting at the mandrel body. These steps serve the purpose of the operating reliability as a whole, since the reel mandrel is exposed to considerable acceleration and retarding forces as well as to high thermal loads. It is also ensured by means of this that an unintentional unlocking of the auxiliary spreading device is not triggered by means of such operating conditions. It is advisable that the holding piece be shaped as an angle iron whose longer side overlaps the radial outer surface of the cam disks and is arranged in grooves which are cut into the radial outer surface of each cam disk, the bent short side of the holding piece engages in an annular groove in the flange of the centering sleeve.

In a particularly advantageous construction of the invention it is provided that the holding piece comprises a predetermined separating point in the area between the cam disks for the purpose of unlocking. The auxiliary spreading device is usually unlocked in that the holding piece connecting the cam disks is removed by undoing a screw connection. However, if the screws cannot be loosened, the holding piece is separated at the predetermined separating point e.g. by means of flame cutting. The auxiliary spreading device is accordingly unlocked and the axial movability of the spreading bar is produced for spreading the reel mandrel.

A substantial construction of the auxiliary spreading device, according to the invention, consists in that the cam disks comprise in each instance two cam segments which are located opposite one another and whose segment surfaces are constructed as inclined support planes which are advantageously connected with one another in a permanent positive-locking connection, advisably in such a way that the common center of gravity of the surface of the cam segments lies in the center of the reel mandrel or in the axis of the spreading bar. The line of action of the axial force in the case of cam pieces lying on top of one another accordingly coincides with the center of the reel mandrel, so that no moment occurs on the spreading devices in the reel mandrel.

In a further development of the auxiliary spreading means with cam disks it is suggested that these cam disks comprise at their outer circumference an actuating member, preferably an actuating pin, which effects the disk rotation, and with which the cam disks can be rotated manually on the annular centering sleeve from the outside by means of a special tool. It is advisable that the cam disks be rotatable in opposite directions on the centering sleeve by angular degrees such that their inclined support planes contact one another in a force-locking manner so as to decrease their spacing relative to one another, as seen in the axial direction of the spreading bar. The support planes of the cam segments advantageously also lie one on top of the other in a permanent manner during the rotation of the cam disks which decreases the spacing, so that tilting moments on the spreading bar are prevented and a tilting of the spreading elements in the reel mandrel is accordingly prevented. As a result, this leads to a very reliable spreading of the reel mandrel in the previously mentioned cases of disturbance.

The various features of novelty which characterize the invention are pointed out with particularity in the claims annexed to and forming a part of this disclosure. For a better understanding of the invention, its operating advantages attained by its use, reference should be had to the drawing and descriptive matter in which there is illustrated and described a preferred embodiment of the invention.

BRIEF DESCRIPTION OF THE DRAWING

In the drawing:

FIGS. 1.1, 1.2 and 1.3 are partial sectional views of portions of the reel mandrel of a strip reel with mandrel body, hydraulically actuated spreading bar, and auxiliary spreading device;

DESCRIPTION OF THE PREFERRED EMBODIMENT

Figure 2:
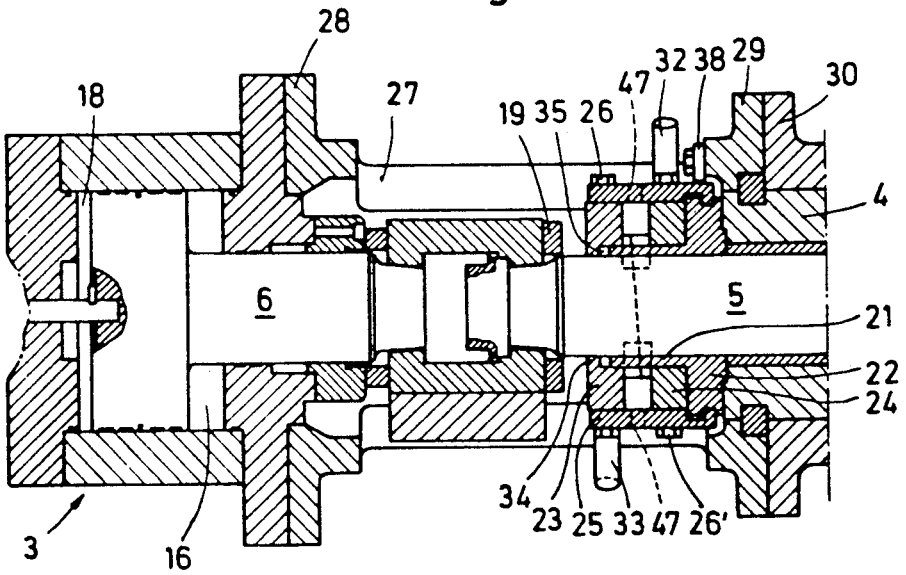
FIG. 2 in a sectional view of the auxiliary spreading device.

FIGS. 1.3–1.3 show the reel mandrel 1 of a strip reel for winding a hot strip 2 from a hot strip rolling mill, not shown. FIG. 1.1 shows the hydraulic drive 3—a double-action piston-cylinder unit—for the spreading bar 5 arranged within the mandrel body 4. The piston rod 6 of the drive 3 is connected with the spreading bar 5 by means of the split coupling 7. In a lengthening of FIG. 1.1 and the mandrel body 4, FIG. 1.2 shows the bearing 8 and the toothed wheel pair 9 for the rotating drive. In a lengthening of FIG. 1.2, FIG. 1.3 shows the bearing 10, the mandrel body 4 and the spreading bar 5 which is axially movable in the mandrel body 4. The spreading bar 5 is connected with the segments 13 of the reel mandrel on which the hot strip 2 is wound via brackets 11 which are guided through openings 12 in the mandrel body. The spreading bar 5 has a plurality of wedge-shaped planes 14 on which wedge elements 15 are supported. The wedge elements 15 are guided through openings in the mandrel body 4 and act on the segments 13 in the radial direction. When a hydraulic medium is admitted to the pressure space 16 of the hydraulic drive 3, the spreading bar moves in the movement direction (arrow 17). The wedge elements 15 wander upward on the wedge surface 14 and press the segments of the reel mandrel radially outward for the purpose of increasing the diameter. On the other hand, if a hydraulic medium is admitted to the pressure space 18 of the hydraulic drive 3, the spreading bar 5 moves, as expected, in the other movement direction and the wedge elements 15 move radially inward on the wedge surfaces 14. The segments 13 simultaneously move radially inward—drawn by means of the brackets 11—so that the diameter of the reel mandrel is reduced. The position of the spreading bar 5, wedge elements 15 and segments 13 corresponding to an after-spreading to approximately 90% of the maximum possible amount of spreading is shown in the upper half of the drawing in FIGS. 1.1 to 1.3. The lower half of the drawing shows the position of the spreading bar, wedge elements and segments in which the hot strip 2 is threaded on the reel mandrel 1. The exact threading position, i.e. the entry diameter, is determined by the lift-limiting ring 19. The lift-limiting ring 19 lies flush between the coupling 7 and the auxiliary spreading device 20. It can be seen from what has been stated previously with regard to the manner of operation of the reel mandrel that the lift-limiting ring impedes further axial movement of the spreading bar 5, even if the pressure space 18 of the hydraulic drive 3 were to be acted upon additionally by the hydraulic medium so as to increase pressure. Further axial movement of the spreading bar 5 for the purpose of a reduction in diameter for the reel mandrel can only be effected when the auxiliary spreading device 20 additionally releases the axial movability of the spreading bar by determined partial distances.

Figure 3:
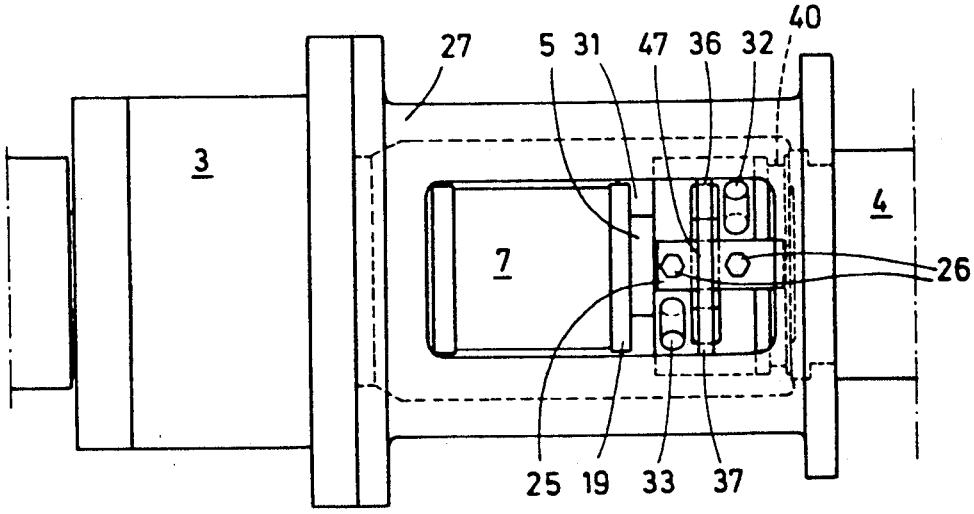
FIG. 3 is a top view of the auxiliary spreading device according to FIG. 2.

FIG. 2 shows the auxiliary spreading device 20. The machine parts described in FIG. 1 are designated by the same reference numbers: hydraulic drive 3 with pressure space 16, 18, piston rod 6, coupling 7, lift-limiting ring 19, spreading bar 5 and mandrel body 4. The auxiliary spreading device comprises an annular centering sleeve 21 with a formed on flange 22 which is connectable with the mandrel body 4, e.g. via a screw connection, the centering sleeve 21 being slid onto the spreading bar 5. Two cam disks 23, 24 which are held so as to be rotatable at a distance from one another and which change with respect to their distance from one another are arranged on the centering sleeve 21. The cam disks 23, 24 are connected with one another by means of a holding piece 25, specifically so as to be detachable by means of a screw connection 26, 26'. The auxiliary spreading device 20 and the coupling 7 are enclosed coaxially by a pipe piece 27 whose pipe flanges 28, 29 are connected on one side with the hydraulic drive 3 and on the other side with a pipe sleeve 30 arranged on the mandrel body 4. The pipe piece 27 is cut out at the outer circumference in the area of the coupling and the auxiliary spreading device 20. Actuating pins 32, 33 are guided through the cut-out portion 31 of the pipe. Two actuating pins are provided for a cam disk 23 and 24 in each instance. The cam disks are held on the centering sleeve 21 so as to be rotatable by means of the actuating pins. The cam disk 23 has a projection 34 and leaves open an axial movement gap 35 between the centering sleeve 21 and the projection 34. It can be seen in FIG. 3 that the holding piece 25 comprises support elements 36, 37. The support elements 36, 37 are constructed as a support arm which is supported on both sides at the pipe piece 27 in order to prevent an unintentional rotation of the auxiliary spreading device 20 on the spreading bar 5. An additional support element is a connection bracket 38 which is arranged on the holding piece 25 and fastened to the pipe piece 27 with a screw connection (FIG. 2). As is shown in FIGS. 1 and 2, the holding piece 25 is shaped as an angle iron whose longer side overlaps the front sides of the cam disks 23, 24 and is arranged in grooves 39 which are cut into the radial outer side of each cam disk, the bent shorter side of the holding piece 25 engages in an annular groove 40 in the flange 22 of the centering sleeve 21 The adjustment of the holding piece 25 in the annular groove 40 in connection with the screw connection of the connection bracket 38 to the pipe piece 27 prevents an axial change of position of the auxiliary spreading device 20 on the spreading bar 5.

Figure 4:
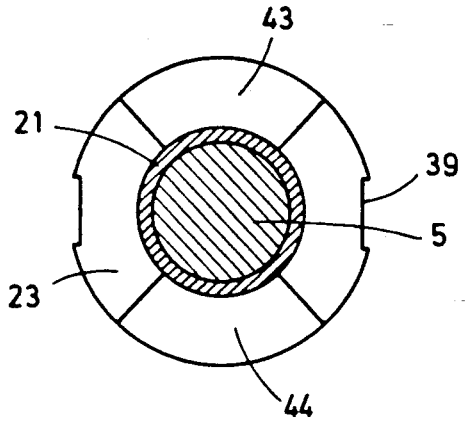
FIG. 4 is an enlarged front view of a cam disk with cam segment.
Figure 5:
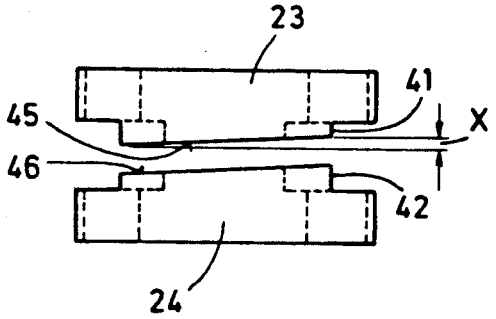
FIG. 5 is a top view of two spaced cam disks.

FIG. 4 and FIG. 5 show that each cam disk 23, 24 comprises two cam segments 41, 42 which are located opposite one another and whose segment surfaces 43, 44 are constructed as inclined support planes 45, 46. The slope X of the support planes 45, 46 is selected so as to be at least as great as the axial adjusting distance of the spreading bar 5 required for the auxiliary spreading of the reel mandrel 1. The magnitude of the segment surfaces is selected in such a way that their allowable surfacearea pressure is not exceeded. In the present case, the cam segments overlap in a maximum angular area of 90°. The cam segments are constructed in such a way that their common surface center of gravity lies in the center of the reel mandrel or in the center of the spreading bar.

To return to the explanations given with respect to FIGS. 1.1-1.3 FIG. 1.3 shows the so-called threading position of the hot strip 2 on the reel mandrel 1 and the threading position of the spreading bar 5. In the event that the auxiliary spreading of the reel mandrel becomes necessary - the after-spreading of the reel mandrel is no longer possible - the auxiliary spreading device 20 unlocks in the following manner: The screw connections 26, 26' between the holding piece 25 and the cam disks 23, 24 are loosened and the screws are removed. The cam disks are now rotatable on the centering sleeve 21. The cam disks are rotated in opposite directions by means of the actuating pins 32, 33 by an angular degree such that the inclined support planes 45, 46 of the cam segments 41, 42 slide on one another in the manner of a screw on a helical surface. The distance between the cam disks is accordingly reduced with the result that a free axial spacing occurs between the lift-limiting ring 19 and the cam disk 23 of the auxiliary spreading device 20. The hydraulic drive 3 can displace the spreading bar 5 in the spreading direction—i.e. opposite the arrow direction 17—by an amount corresponding to the free axial movability until the lift-limiting ring again contacts the outer cam disk 23. The diameter of the reel mandrel is compulsorily reduced by a determined amount which is large enough so that the coil, which is clamped due to the failure of the after-spreading, is stripped off from the reel mandrel with the usual steps. When the auxiliary spreading is effected, the cam disks 23, 24 are rotated back into their original position after the hydraulic unloading of the drive 3 by means of the actuating pins 32, 33 and the holding piece 25 is screwed together with the cam disks again. The mechanically acting auxiliary spreading device 20 requires low maintenance and can be employed very quickly in the event of disturbance. If the screws of the screw connection 26, 26' cannot be loosened, the holding pieces 25 are separated from one another in the area between the cam disks 23, 24 at a marked predetermined separating point 47, e.g. by means of flame cutting, whereupon the two cam disks can be rotated as described above in opposite directions, so that an axial lift of the spreading bar 5 is freed and a closing of the reel mandrel can accordingly be effected. Since the cam disks are in a forcelocking engagement after the removal of the holding pieces 25 (by means of unscrewing or by means of a separating cut), the cam disks will not rotate automatically as a result of the friction between the segment surfaces, so that the action of an outer impact force at the actuating pins is required for loosening.

It is clear from the preceding statements that the auxiliary spreading device 20 can be adapted to the most various conditions of use by means of a different construction of the lift-limiting ring 19 and the slope of the inclined support planes 45, 46 of the cam disks 23, 24.

While a specific embodiment of the invention has been shown and described in detail to illustrate the inventive principles, it will be understood that the invention may be embodied otherwise without departing from such principles.

We claim:

1. In a strip reel for winding metal strips to form a coil and for winding metal strips from a coil such that the edges of the strips are aligned, particularly for winding rolled hot strips, the strip reel including a drivel reel mandrel which is supported so as to be rotatable, the reel mandrel substantially including a mandrel body, spreadable segments and a spreading bar, wherein the segments of the reel mandrel are spreadable in radial direction by means of the spreading bar, the spreading bar being mounted axially movable in the mandrel body, a coupling and rotating drive being mounted between the mandrel body and the spreading bar, the strip reel further including an auxiliary spreading device, the improvement comprising the coupling having a lift-limiting ring, the auxiliary spreading device being mounted between the lift-limiting ring and the mandrel body, the auxiliary spreading device angularly surrounding the spreading bar, an annular centering sleeve being mounted on the spreading bar, the annular centering sleeve having an integrally formed flange, means for connecting the flange to the mandrel body, at least two spaced-apart cam disks being rotatably mounted on the annular centering sleeve, such that the distance between the cam disks is adjustable, and at least one holding piece detachably connected to the cam disks.

2. The strip reel according to claim 1, comprising support elements acting on the mandrel body for securing the holding piece against rotation and for securing the holding piece without play in axial direction.

3. The strip reel according to claim 2, wherein the holding piece is an angle-shaped iron having a long side and a short side, the cam disks having front sides, the long side of the holding piece overlapping the front sides of the cam disks, each cam disk having a radial outer surface, each radial outer surface defining grooves, the long side of the iron engaging in the grooves, the centering sleeve having a flange with annular grooves, the short side of the holding piece being bent and engaging in the annular groove.

4. The strip reel according to claim 2, wherein the holding piece comprises a predetermined separating point in an area between the cam disks.

5. The strip reel according to claim 1, wherein each cam disk comprises two cam segments with segment surfaces, the cam segments being located opposite one another and the segment surfaces being inclined support planes.

6. The strip reel according to claim 5, wherein the cam segments have a common surface center of gravity, the common surface center of gravity being located in the center of the reel mandrel and in the axis of the spreading bar.

7. The strip reel according to claim 1, wherein each cam disk has on an outer circumference thereof an actuating member for effecting rotation of the disk.

8. The strip reel according to claim 7, wherein the actuating member is an actuating pin.

9. The strip reel according to claim 5, wherein the cam disks are mounted so as to be rotatable in opposite directions on the centering sleeve by an angle which results in the inclined support planes contacting one another in a frictionally engaging manner for decreasing the spacing therebetween.

* * * * *